US011627791B2

(12) United States Patent
Sakr

(10) Patent No.: US 11,627,791 B2
(45) Date of Patent: Apr. 18, 2023

(54) MTIP, WAXING, COSMETIC, HYGIENE AND UTILITY TOOL

(71) Applicant: Nidal Sakr, Huntington Beach, CA (US)

(72) Inventor: Nidal Sakr, Huntington Beach, CA (US)

( * ) Notice: Subject to any disclaimer, the term of this patent is extended or adjusted under 35 U.S.C. 154(b) by 91 days.

(21) Appl. No.: 17/100,055

(22) Filed: Nov. 20, 2020

(65) Prior Publication Data

US 2021/0085052 A1 Mar. 25, 2021

Related U.S. Application Data

(63) Continuation-in-part of application No. 16/025,409, filed on Jul. 2, 2018, now abandoned.

(51) Int. Cl.
*A45D 26/00* (2006.01)

(52) U.S. Cl.
CPC ..... *A45D 26/0014* (2013.01); *A45D 26/0019* (2013.01); *A45D 2200/10* (2013.01)

(58) Field of Classification Search
CPC ..... A45D 26/0014; A45D 26/0019; A45D 26/0061; A45D 2200/1036; A45D 2200/1045; A61F 13/38; A61F 13/385; A61F 11/006
See application file for complete search history.

(56) References Cited

U.S. PATENT DOCUMENTS

| | | | | |
|---|---|---|---|---|
| 9,498,383 | B2 | 11/2016 | Colson Edme | |
| 9,968,172 | B2 * | 5/2018 | Ismiel-Nash | A45D 26/00 |
| 2008/0208100 | A1 | 8/2008 | Wolff | |
| 2009/0232580 | A1 * | 9/2009 | Castel | A45D 34/04 401/266 |
| 2011/0126371 | A1 * | 6/2011 | Koehl | A45D 34/04 15/210.1 |
| 2018/0028419 | A1 * | 2/2018 | Saaid | A45D 26/0014 606/134 |
| 2021/0085052 | A1 * | 3/2021 | Sakr | A45D 26/0019 |

* cited by examiner

*Primary Examiner* — Todd J Scherbel
(74) *Attorney, Agent, or Firm* — Eandi Fitzpatrick LLP

(57) ABSTRACT

A disposal cosmetic tool is provided and has a stem having a first end and second end, wherein the stem is configured for a user to hold; a first bulb located at the first end of the stem, wherein the first bulb section has a surface coated with an adhesive configured for hair removal; a second bulb located at the second end of the stem, wherein the second bulb section has a surface impregnated or coated with a finishing oil; wherein the first bulb surface has a hardness that is greater than the second bulb surface.

20 Claims, 4 Drawing Sheets

MTIP, WAXING, COSMETIC, HYGIENE AND UTILITY TOOL

CROSS-REFERENCE TO RELATED APPLICATIONS

This application is a continuation in part of U.S. patent application Ser. No. 16/025,409 entitled MTip, Waxing, Cosmetic, Hygiene & Utility Tool filed Jul. 2, 2018, the entire contents of each application listed above are each incorporated by reference herein for all purposes.

FIELD OF THE INVENTION

The present disclosure relates generally relates to cosmetic tool. More particularly, the present disclosure relates to a disposable hair removal tool.

BACKGROUND OF THE INVENTION

The removal of unwanted body hair has long been an important part of personal hygiene and grooming. Hair removal may be practiced for cultural, aesthetic, hygienic, sexual, medical or religious reasons. Forms of hair removal have been practiced in almost all human cultures since at least the Neolithic era. The methods used to remove hair have varied in different times and regions, but shaving is the most common method.

There are two forms of hair removal: Depilation methods, and Epilation methods. Depilation or temporary removal of hair to the level of the skin, lasts several hours to several days and can be achieved by shaving or trimming (manually or with electric shavers), depilatories (creams or "shaving powders" which chemically dissolve hair), and friction (rough surfaces used to buff away hair). Epilation methods refer to removal of the entire hair from the root, lasts several days to several weeks and may be achieved by tweezing (hairs are tweezed, or pulled out, with tweezers or with fingers) waxing (a hot or cold layer is applied and then removed with porous strips), sugaring (hair is removed by applying a sticky paste to the skin in the direction of hair growth and then peeling off with a porous strip) among other methods.

However, many of these epilation methods can be costly, inconvenient and painful. Waxing for example requires a user to have a waxing kit and heat wax that is then used to remove hair. Many times, the user must go to a professional which is expensive. Furthermore, waxing makes it difficult to remove hairs in small orifices and small contoured areas of an individual's body such as the ears and nose.

As such, there is a need for a convenient and inexpensive tool to remove unwanted hair.

SUMMARY OF THE INVENTION

To achieve the foregoing and other aspects and in accordance with the purpose of the invention, a preformed waxing tool is disclosed.

In an embodiment, a disposal cosmetic tool is provided. The tool comprises a stem having a first end and second end, wherein the stem is configured for a user to hold; a first bulb located at the first end of the stem, wherein the first bulb section has a surface coated with an adhesive configured for hair removal; a second bulb located at the second end of the stem, wherein the second bulb section has a surface impregnated or coated with a finishing oil; wherein the first bulb surface has a hardness that is greater than the second bulb surface.

In embodiments, a method of manufacturing a cosmetic tool, the method comprising forming a stem having a first end and second end, a first bulb located at the first end of the stem and a second bulb located at the second end of the stem, wherein the stem is configured for a user to hold; coating the first bulb with an adhesive configured for hair removal; impregnating the second bulb with a finishing oil; wherein the first bulb surface has a hardness that is greater than the second bulb surface.

The present tool provides advantages because a single inexpensive disposal tool can be used for hair removal and to remove adhesive whilst soothing the effected area.

Other features, advantages, and aspects of the present system will become more apparent and be more readily understood from the following detailed description, which should be read in conjunction with the accompanying drawings.

BRIEF DESCRIPTION OF THE DRAWINGS

The present system is illustrated by way of example, and not by way of limitation, in the figures of the accompanying drawings and in which like reference numerals refer to similar elements and in which.

Figure 1:
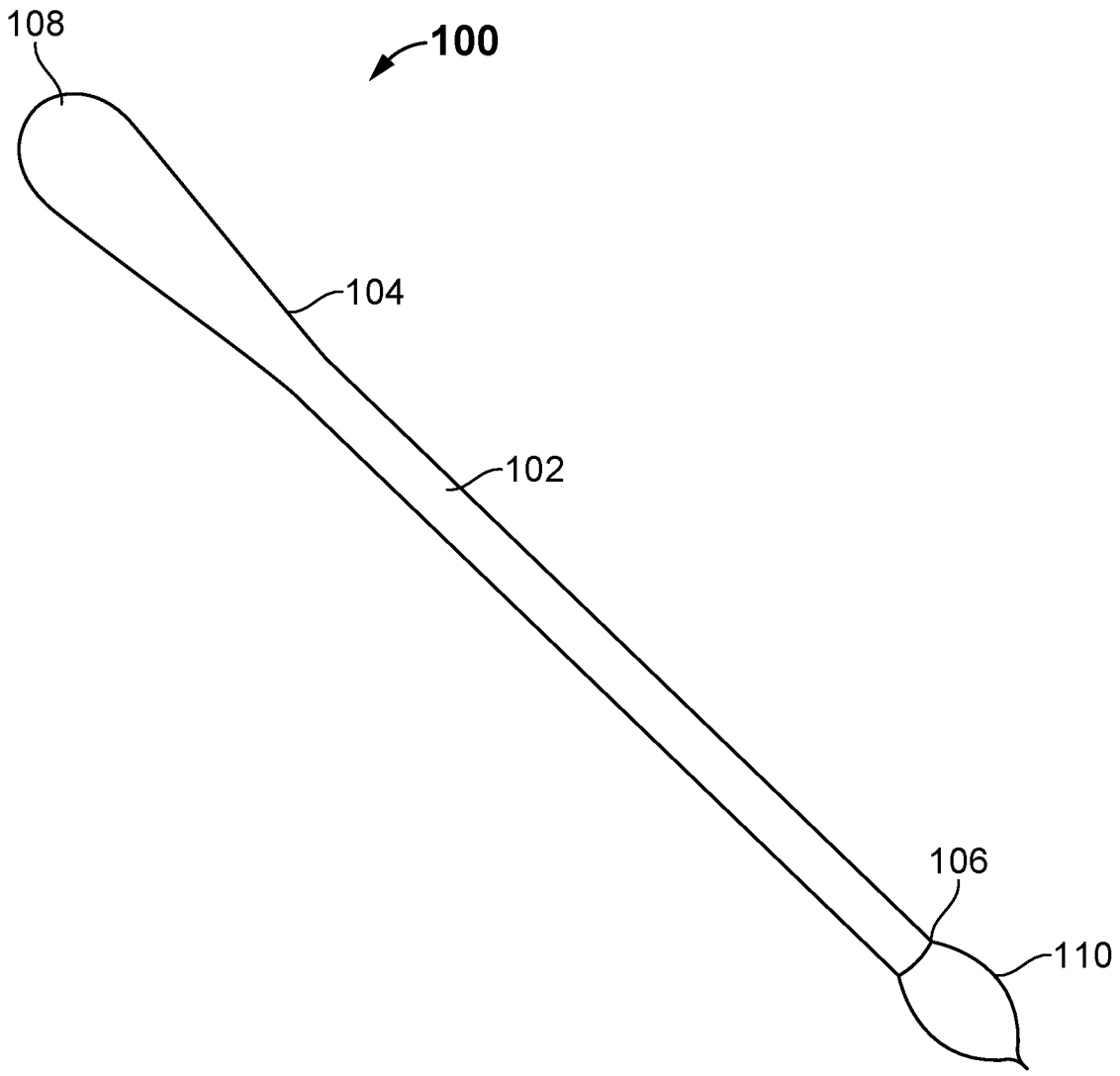
FIG. 1 illustrates a perspective view of a cosmetic tool according to a embodiment of the present invention.

The drawings referred to in this description are not to be understood as being drawn to scale except if specifically noted, and such drawings are only exemplary in nature.

DETAILED DESCRIPTION OF THE PREFERRED EMBODIMENTS

The present system is best understood by reference to the detailed description and examples set forth herein.

Embodiments of the system are discussed below with reference to the examples. However, those skilled in the art will readily appreciate that the detailed description given herein with respect to these examples is for explanatory purposes as the system extends beyond these limited embodiments. For example, it should be appreciated that those skilled in the art will, in light of the teachings of the present system, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the system that are too numerous to be listed but that all fit within the scope of the system. Also, singular words should be read as plural and vice versa and masculine as feminine and vice versa, where appropriate, and alternative embodiments do not necessarily imply that the two are mutually exclusive.

It is to be further understood that the present system is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present system. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this system belongs. Preferred methods, techniques, devices, and materials are described, although any methods, techniques, devices, or materials similar or equivalent to those described herein may be used in the practice or testing of the present system With reference now to FIG. 1, a disposable cosmetic tool for removing hair in hard to reach places is shown generally at reference numeral 100. The tool comprises a stem 102 having a first end 104, a second end 106, a first bulb 108 and a second bulb 110.

The stem 102 is configured to allow a user to easily and ergonomically hold the tool. In this way, the stem 102 is formed or manufactured from a sold mold comprising plastic, wood, paper, or any combination thereof. In embodiments, the stem may be, as an example, 8 cm long.

The first bulb 108 is positioned at the first end 104 of the stem 102. The first bulb may be formed from one-piece construction with the stem, meaning the stem 102 and first bulb 108 are formed as one contiguous piece or element to form the tool 100.

The first bulb 108 has a surface that comprises micro-dimples (shown in greater detail with relation to FIG. 2), and is coated with an adhesive that covers or fills in the micro-dimples and the surface of the first bulb 108. In optional embodiments, the first bulb 108 is smooth and is coated with an adhesive that will adhere to the surface. In this way, different types of adhesives may be used.

In embodiments, the adhesive may be a soft wax that is at least partially liquified or softened to allow the first bulb 108 to be dipped into the wax. When the first bulb 108 is removed from the liquified or semi-liquified wax adhesive it solidifies at room temperature and retaining its adhesiveness. In embodiments, the soft wax may comprise Glycerol, Hydrogenated Rosinate, Triethylene Glycol, Hydrogenated Rosinate, Carthamus Tinctorius (Safflower) Seed Oil, Ricinus Communist (Castor) Seed Oil, Parfum/Fragrance, Cocos Nucifera (Coconut) Oil, Sclerocarya Birrea Seed Oil, Linalool, Tocopheryl Acetate, Propylparaben, Retinyl Palmitate, Paraffinum Liquidum, Mineral Oil, Huile Minerale, Camellia Oleifera Leaf Extract, Macrcystis Pyriefera (Kelp) Extract, Dulcis Orchis Maculata Flower Extract, Citrus Aurantium (Orange) Flower Extract, Passiflora Incarnata Extract, Aloe Barbadensis Leaf Extract, Titanium Dioxide (C177891) or any combination thereof.

In operation, a user may press the first bulb into their nostril or ear and apply soft to moderate pressure, then quickly remove the bulb to remove the unwanted hair.

Referring still to FIG. 1, the second bulb 110 is positioned at the second end 106 of the stem 102. The second bulb may either be formed with the stem in one-piece construction (through formed with a different material) or the second bulb 110 may be a wrapped around or coupled to the second end 106 of the stem 102.

The second bulb 110 is formed of a material with a surface that may be impregnated or coated with a finishing oil. In this way, the first bulb 108 surface has a hardness that is greater than the second bulb 110 surface.

In one embodiment, the second bulb surface is formed of a fiber comprising cotton, wool, silk, or any combination therein if the material of the second bulb is coated, whereas the second bulb may be formed of a gel that is impregnated with finishing oil if impregnation is used. In embodiments, the second bulb 110 comprises a liquid-impregnated surface having two distinct layers. The first may be textured or porous substrate with features spaced sufficiently close to stably contain the second layer which is an impregnating liquid that fills in the spaces between these features. In this way, a finishing oil can be impregnated and used by the user.

In embodiments, the finishing oil comprises Ethylhexyl Isononanoate, Sesamum Indicum (Sesame) Seed Oil, C13-14 Isoparaffin, Phenoxyethanol, Menthol, Methylparaben, Propylparaben, Tocopherol, Ethylparaben, Guaiazulene, or any combination thereof.

In operation, after the first bulb 108 is used to remove hair, the user can then use the second bulb to remove excess adhesive from a skin of the user and to sooth an area of the hair removal.

Figure 2:
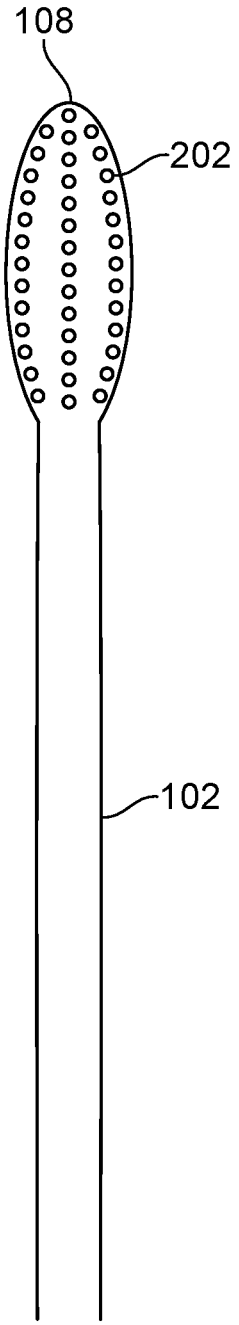
FIG. 2 illustrates a perspective view of a first bulb according to an embodiment of the present invention.

Referring now to FIG. 2, the first bulb is shown more closely. The first bulb 108, in this embodiment, comprises micro-dimples 202 that are configured to compartmentalize and facilitate the appropriate amount adhesive to bond with the first bulb 108. In optional embodiments, depending upon the type adhesive used, the first bulb may be smooth. The micro-dimples 202 may be any useful shape or size as a function of the application that the tool is to be used for.

Figure 3:
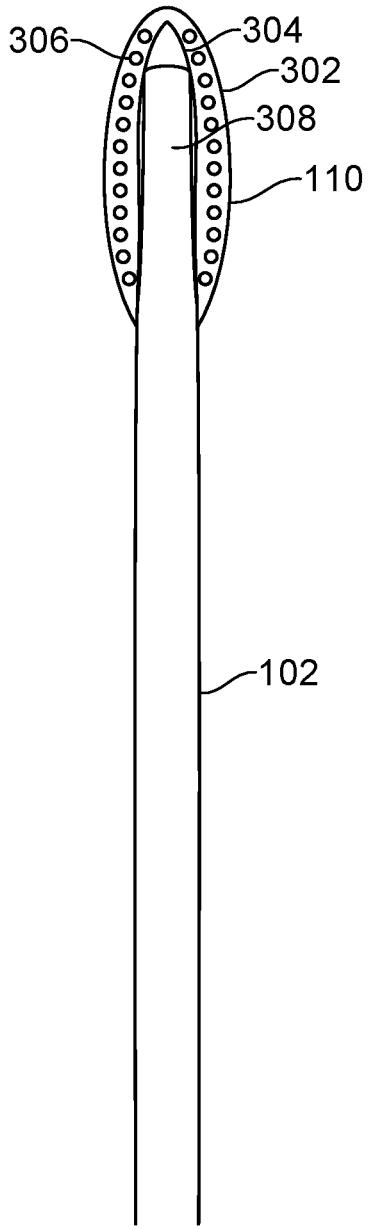
FIG. 3 illustrates a perspective view of a second bulb according to an embodiment of the present invention.

Referring now to FIG. 3, the second bulb is shown more closely. The second bulb 110 comprise an outer layer 302 having pores 306, an inner layer 304. The outer layer 302 is a porous substrate with features spaced sufficiently close to stably contain the inner layer 304 which is an impregnating finishing oil that fills in the spaces between the outer and inner layers 302 and 304. In operation, when a user applies pressure, the finishing oil is released.

Also seen in FIG. 3 is how the stem 102 may form part of the second bulb 110 in that the stem has a portion 308 that forms the internal structure of the second bulb 110, and the material on the second bulb 110 is connected to that portion.

Figure 4:
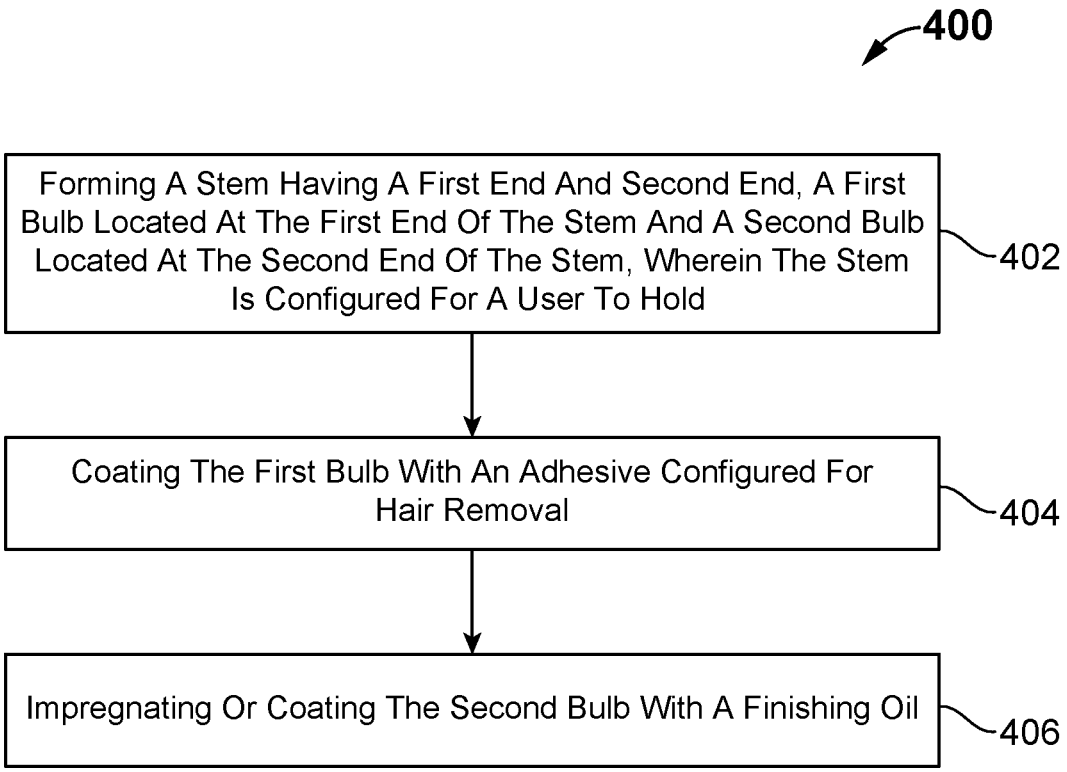
FIG. 4 illustrates a step-wise method for manufacturing a cosmetic tool.

Referring now to FIG. 4, a method of manufacturing a cosmetic tool is provided at reference numeral 400.

At step 402, forming a stem having a first end and second end, a first bulb located at the first end of the stem and a second bulb located at the second end of the stem, wherein the stem is configured for a user to hold.

At step 404, coating the first bulb with an adhesive configured for hair removal, At step 406, impregnating the second bulb with a finishing oil, wherein the first bulb surface has a hardness that is greater than the second bulb surface.

Although specific features of various embodiments of the system may be shown in some drawings and not in others, this is for convenience only. In accordance with the principles of the system, the feature(s) of one drawing may be combined with any or all of the features in any of the other drawings. The words "including", "comprising", "having", and "with" as used herein are to be interpreted broadly and comprehensively and are not limited to any physical interconnection. Moreover, any embodiments disclosed herein are not to be interpreted as the only possible embodiments. Rather, modifications and other embodiments are intended to be included within the scope of the appended claims.

The invention claimed is:

1. A cosmetic tool comprising:

a stem having a first end and a second end, wherein the stem is configured for a user to hold;

a first bulb located at the first end of the stem, wherein the first bulb has a surface coated with an adhesive having a minimum strength to remove hair;

a second bulb located at the second end of the stem, wherein the second bulb has a surface having an outer layer and an inner layer, wherein the outer layer comprises pores and the inner layer is impregnated with a finishing oil, wherein the finishing oil fills in a space between the outer layer and the inner layer;

wherein the first bulb surface configured for hair removal has a hardness that is greater than the second bulb surface configured for adhesive removal.

2. The cosmetic tool of claim 1, wherein the stem and the first bulb surface are formed of a mold comprising plastic, wood, paper, or any combination thereof.

3. The cosmetic tool of claim 1, wherein the second bulb surface is formed of a fiber comprising cotton, wool, silk, or any combination thereof.

4. The cosmetic tool of claim 3, wherein the finishing oil comprises Ethylhexyl Isononanoate, *Sesamum Indicum* (Sesame) Seed Oil, C13-14 Isoparaffin, Phenoxyethanol, Menthol, Methylparaben, Propylparaben, Tocopherol, Ethylparaben, Guaiazulene, or any combination thereof.

5. The cosmetic tool of claim 1, wherein the finishing oil is configured to remove excess adhesive from a skin of the user and to sooth an area of the hair removal.

6. The cosmetic tool of claim 1, wherein the second bulb is formed of a gel that is impregnated with the finishing oil.

7. The cosmetic tool of claim 6, wherein the adhesive comprises Glycerol, Hydrogenated Rosinate, Triethylene Glycol, Hydrogenated Rosinate, Carthamus Tinctorius (Safflower) Seed Oil, *Ricinus* Communist (Castor) Seed Oil, Parfum/Fragrance, *Cocos Nucifera* (Coconut) Oil, Sclerocarya Birrea Seed Oil, Linalool, Tocopheryl Acetate, Propylparaben, Retinyl Palmitate, Paraffinum Liquidum, Mineral Oil, Huile Minerale, *Camellia* Oleifera Leaf Extract, Macrcystis Pyriefera (Kelp) Extract, *Dulcis* Orchis *Maculata* Flower Extract, Citrus Aurantium (Orange) Flower Extract, *Passiflora Incarnata* Extract, Aloe Barbadensis Leaf Extract, Titanium Dioxide (C177891) or any combination thereof.

8. The cosmetic tool of claim 1, wherein the adhesive is configured to remove hair from ear canals and nostrils when the user applies pressure to a hair removal area removing the first bulb from the hair removal area.

9. The cosmetic tool of claim 1, wherein the stem, first bulb and second bulb are formed in one-part construction.

10. The cosmetic tool of claim 1, wherein the first bulb surface comprises micro-dimples, and wherein the second bulb surface has an inside portion that is part of the stem.

11. A method of manufacturing a cosmetic tool, the method comprising:

forming a stem having a first end and a second end, a first bulb located at the first end of the stem and a second bulb located at the second end of the stem, wherein the stem is configured for a user to hold;

coating a surface of the first bulb with an adhesive having a minimum strength to remove hair;

impregnating the second bulb with a finishing oil, wherein the second bulb comprises an outer layer having pores and an inner layer impregnated with the finishing oil, wherein the finishing oil fills in a space between the outer layer and the inner layer;

wherein the first bulb surface has a hardness that is greater than a second bulb surface.

12. The method of claim 11, wherein the stem and the first bulb surface are formed of a mold comprising plastic, wood, paper, or any combination thereof.

13. The method of claim 11, wherein the second bulb surface is formed of a fiber comprising cotton, wool, silk, or any combination therein.

14. The method of claim 13, wherein the finishing oil comprises Ethylhexyl Isononanoate, *Sesamum Indicum* (Sesame) Seed Oil, C13-14 Isoparaffin, Phenoxyethanol, Menthol, Methylparaben, Propylparaben, Tocopherol, Ethylparaben, Guaiazulene, or any combination thereof.

15. The method of claim 11, wherein the finishing oil is configured to remove excess adhesive from a skin of the user and to sooth an area of the hair removal.

16. The method of claim 11, further comprising dipping the first bulb into a heated liquid or semi-solid adhesive until the first end fully submerged;

removing the first bulb from the adhesive and leaving at room temperature to solidify the adhesive;

dipping the second bulb into the finishing oil;

removing the second bulb from the finishing oil after the finishing oil impregnates the second bulb such that when pressure is applied, the finishing oil seeps out of the bulb, wherein the second bulb is formed of a gel that is impregnated with the finishing oil.

17. The method of claim 11, wherein the adhesive comprises Glycerol, Hydrogenated Rosinate, Triethylene Glycol, Hydrogenated Rosinate, Carthamus Tinctorius (Safflower) Seed Oil, *Ricinus* Communist (Castor) Seed Oil, Parfum/Fragrance, *Cocos Nucifera* (Coconut) Oil, Sclerocarya Birrea Seed Oil, Linalool, Tocopheryl Acetate, Propylparaben, Retinyl Palmitate, Paraffinum Liquidum, Mineral Oil, Huile Minerale, *Camellia* Oleifera Leaf Extract, Macrcystis Pyriefera (Kelp) Extract, *Dulcis* Orchis *Maculata* Flower Extract, Citrus Aurantium (Orange) Flower Extract, *Passiflora Incarnata* Extract, Aloe Barbadensis Leaf Extract, Titanium Dioxide (C177891) or any combination thereof.

18. The method of claim 11, wherein the adhesive is configured to remove hair from ear canals and nostrils when the user applies pressure to a hair removal area removing the first bulb from the hair removal area.

19. The method of claim 11, wherein the stem, first bulb and second bulb are formed in one-part construction.

20. The method of claim 11, wherein the first bulb surface comprises dimples, and wherein the second bulb surface has an inside portion that is part of the stem.

* * * * *